United States Patent [19]

Bryden et al.

[11] Patent Number: 4,852,783

[45] Date of Patent: Aug. 1, 1989

[54] MULTI-COMPARTMENT RECEPTACLE FOR INDIVIDUALLY PACKAGING AND DISPENSING PAIRS OF GLOVES FOR USE BY HEALTH CARE OR EMERGENCY RESCUE PERSONNEL

[76] Inventors: Norman E. Bryden, 2407 Arden Dr., Champaign, Ill. 61821; Philip B. Johnson, 809 W. Sunset Dr., Mahomet, Ill. 61853

[21] Appl. No.: 195,042

[22] Filed: May 17, 1988

[51] Int. Cl.[4] ..... A45F 5/00; B65D 65/12; B65D 85/18

[52] U.S. Cl. ..... 224/253; 224/240; 224/241; 224/271; 224/901; 150/52 R; 150/149; 206/279; 206/438; 229/87 A; 383/39

[58] Field of Search ..... 224/223, 224, 226–229, 224/235, 236, 240, 241, 253, 271, 901; 150/52 R, 132, 138, 143, 147, 149; 383/39; 229/87 A; 206/279, 438, 278, 299

[56] References Cited

U.S. PATENT DOCUMENTS

| | | | |
|---|---|---|---|
| 814,205 | 3/1906 | Hawes | 150/149 |
| 860,264 | 7/1907 | Stevens | 150/52 R |
| 1,245,805 | 11/1917 | Schneider | 206/366 |
| 1,561,343 | 11/1925 | Michaels | 150/143 |
| 2,397,200 | 3/1946 | Perry | 224/236 |
| 2,590,187 | 3/1952 | Langos . | |
| 2,754,867 | 7/1956 | Langer | 383/39 |
| 2,810,417 | 10/1957 | Yerk | 150/52 R |
| 2,908,308 | 10/1959 | Dearholt | 150/52 R |
| 2,915,173 | 12/1959 | Langdon . | |
| 3,092,249 | 6/1963 | Chapman . | |
| 3,147,896 | 9/1964 | Kehl | 224/240 |
| 3,286,831 | 11/1966 | Giberstein . | |
| 3,366,228 | 12/1968 | Nye | 229/87 A |
| 3,384,225 | 5/1968 | Nye | 229/87 A |
| 3,472,369 | 10/1969 | Schuster . | |
| 3,494,726 | 2/1970 | Barasch . | |
| 3,857,484 | 12/1974 | Thyen . | |
| 3,861,521 | 1/1975 | Burtz . | |
| 3,892,314 | 7/1975 | Semp . | |
| 4,068,757 | 1/1978 | Casey . | |
| 4,099,614 | 7/1978 | Heissenberger . | |
| 4,142,632 | 3/1979 | Sandel . | |
| 4,324,331 | 4/1982 | Ignasiak . | |
| 4,342,390 | 8/1982 | Mitchell et al. . | |
| 4,402,453 | 9/1983 | Regenstein, Jr. . | |

*Primary Examiner*—Henry J. Recla
*Assistant Examiner*—Robert Fetsuga
*Attorney, Agent, or Firm*—James A. Wong

[57] ABSTRACT

A multi-compartment receptacle for packaging and storing a plurality of pairs of protective gloves to be carried by a single person whereby each pair of gloves may be distributed to one of several persons on a rescue team, hospital crew, or like persons, the receptacle comprising a web of foldable flexible material which in extended condition includes a closure flap, a series of hinge areas, a series of compartments, first and second securing members, and a carrying member. Such web of material, including a front and back side, with the compartments being disposed on the front side of the web, the carrying member being disposed on the back side of the web behind the first compartment, each of the compartments having an opening along an upper edge thereof, each of the hinge areas extending transversely from side to side of the web above the opening of one of the compartments whereby each compartment starting with the last compartment may be folded along a preceding one of the hinge areas over a preceding one of the compartments. The closure flap being disposed above the first one of the hinge areas and extending to a free end of the web of material whereby the closure flap may be folded along the first hinge area over the compartments after each of the compartments has been folded against the respective preceding compartment.

16 Claims, 2 Drawing Sheets

MULTI-COMPARTMENT RECEPTACLE FOR INDIVIDUALLY PACKAGING AND DISPENSING PAIRS OF GLOVES FOR USE BY HEALTH CARE OR EMERGENCY RESCUE PERSONNEL

BACKGROUND OF THE INVENTION

1. Field of the Invention

The present invention relates to a receptacle for packaging, storing, and dispensing gloves to be used by health care or emergency rescue personnel. Traditionally, the use of surgical gloves was based upon the desideratum of maintaining sanitary conditions for the protection of the sick or disabled. With the advent of acquired immune deficiency syndrome, more commonly known as AIDS, the fears of possible infection from handling human blood and/or body fluids have become somewhat of a phobia among health care and/or emergency rescue personnel. As a result of the fears of such health care and/or emergency rescue personnel, there has been a significant increase in the use of protective gloves which heretofore were worn principally for the protection of the sick or disabled. The use of such gloves now serve the manifold purpose of allaying the fears of the health care and/or emergency rescue personnel as well as of protecting the sick and the disabled. Hopefully, the use of such gloves will realistically afford the health care and/or emergency rescue workers the desired protection against infection in their work place and permit OSHA requirements of January 1988 to be met. In any event, the allaying of such fears should at least enhance the availability of health care and rescue personnel as well as provide them with surer hands in their work.

2. Description of the Prior Art

Prior art packages generally are of the type which contain a single pair of surgical gloves for use by a single health care worker who individually scrubbed himself or herself and drew out a single pair of gloves to use. While it is possible that some prior art packages contain more than one pair of gloves, such packages if they do exist probably were based upon economics and/or convenience rather than upon the prevalent need for numerous pairs of gloves on any given situation to meet the demands of teams of rescue workers and/or health care persons.

SUMMARY OF THE INVENTION

With the background set forth above, it can be appreciated that the present invention provides a new and improved receptacle in which a plurality of pairs of protective gloves may be packaged and stored until removed for use.

It is also an object of this invention to provide a new and improved receptacle in which protective gloves may be carried and dispensed for use on demand.

Accordingly, it is another object of this invention to provide a new and improved receptacle in which a plurality of pairs of protective gloves may be transported for use, if necessary, and when necessary.

It is a further object of this invention to provide a new and improved receptacle in which a plurality of pairs of protective gloves may be individually stored under sanitary conditions, yet in a single package.

It is still another object of this invention to provide a new and improved receptacle in which a plurality of pairs of protective gloves may be individually stored in a single package and yet be in individually withdrawn or dispensed from the package without disturbing or breaching the sanitary condition of the remaining pairs of gloves in the package.

With the foregoing background and objects in mind, the reader will readily appreciate the advantages flowing from the invention disclosed herein over the prior devices upon perusing the specification and noting the form of the invention illustrated in the accompanying drawings.

BRIEF DESCRIPTION OF THE DRAWINGS

Referring to the accompanying drawings, the reader will see that.

DESCRIPTION OF THE PREFERRED EMBODIMENT

Figure 1:
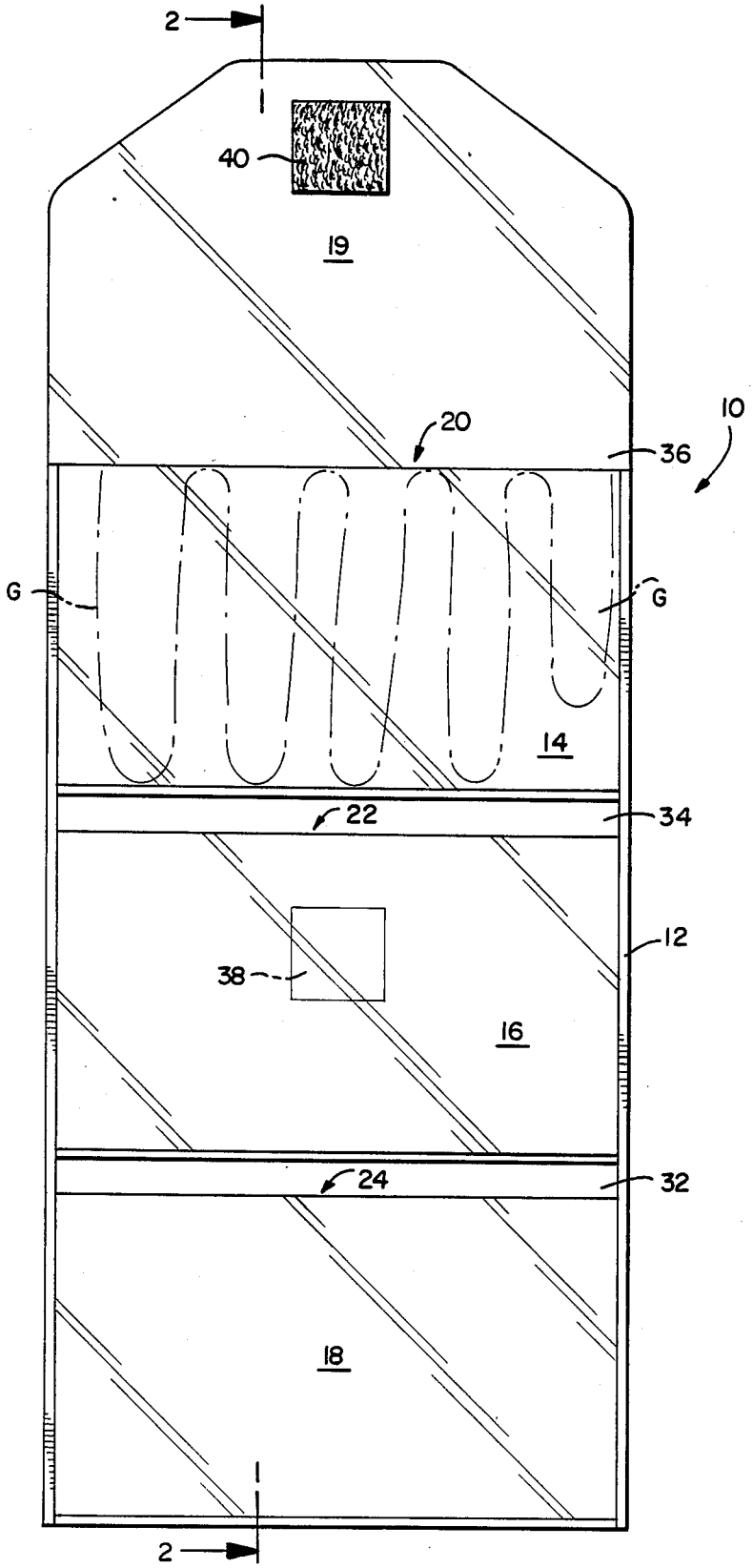
FIG. 1 is a front elevational view of the receptacle according to the disclosed invention in its extended condition, affording access to compartments or pockets thereof.
Figure 2:
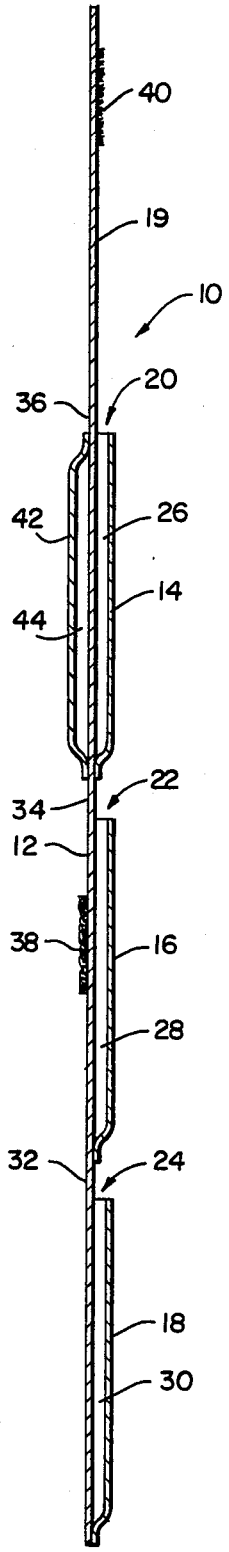
FIG. 2 is a sectional view of the disclosed invention taken along the plane 2—2 and looking in the direction of the arrows in FIG. 1.

Referring now in detail to the drawings, the reader will readily appreciate that the disclosed receptacle 10 according to the present invention as illustrated in FIGS. 1 and 2 is in fully extended or open condition in which the contents such as protective gloves G designated in phantom may be inserted or from which such gloves G may be withdrawn and distributed to user personnel. The disclosed invention is embodied as a multi-compartment receptacle 10 for packaging and storing a plurality of pairs of protective gloves G to be carried by a single person whereby each pair of gloves G may be distributed to one of several persons on a rescue team, hospital crew, or like group of persons. The receptacle 10, as disclosed, comprises a web 12 of foldable flexible material which, in an extended condition thereof, includes a closure flap 19 and a series of hinge areas 36, 34, 32. Disposed beneath and adjacent the hinge areas 36, 34, 32 is a series of compartments 26, 28, 30, respectively, formed with heat sealed seams along the bottom and opposite side edges thereof and adhered to web 12. First and second securing members 40 and 38 are provided to close the package. The securing members may take the form of snap buttons or the like. Applicants have chosen Velcro members 40, 38 as the package securing means. A carrying member 42 is provided on the back side of web 12.

On the front side of web 12, compartments 26, 28, 30 are formed in a series as may be clearly seen in FIG. 2, while the carrying member 42 is disposed on the back side behind the first compartment 26. Each of the compartments 26, 28, 30 has an opening 20, 22, 24, respectively, along an upper edge thereof adjacent to and beneath each of the hinge areas 36, 34, 32 extending transversely from side to side of the web 12 of material. Each of the compartments 26, 28, 30 starting with the last compartment 30 may be folded along a preceding one of the hinge areas 32, 34 over a preceding one of the compartments. The closure flap 19 is disposed above the first one of the hinge areas 36 and extends to a free end of the web 12 of material whereby closure flap 19 may be folded downwardly along first hinge area 36 over the compartments after compartments 30, 28 have been folded against the respective preceding compartments 28, 26, including compartment 26. The first securing member 40 is disposed on the front side of the web 12 of material on closure flap 19. The second securing member 38 is disposed on the back of the web 12 of material behind the second compartment 28 in a position accessible for contact and cooperation with the first securing member 40 when closure flap 19 is folded thereagainst, as illustrated in FIG. 5, and thus provides a secure package.

It is further within the concept of the present invention that the web 12 of material and that each of the compartments 26, 28, 30 be formed from clear or transparent plastic material. Compartments 26, 28, 30 are each formed from individual sheets or panels 14, 16, 18, respectively, of clear plastic material. Each panel 14, 16, 18 is formed with a single heat sealed edge seam along the bottom and opposite side edges of the compartments 26, 28, 30. The carrying member 42 may also be formed from a sheet of plastic material which, for convenience, may also be of clear plastic cut from the same stock. Carrying member 42, as may be seen in FIG. 2, is adhered along upper and lower edges thereof to the back of web 12, thus providing a loop passage 44 for or otherwise accommodating a carrying belt B illustrated in phantom in FIG. 5 to be worn by rescue personnel or the like. It may further be noted that carrying member 42 is adhered to the back side of web 12 behind the first or upper compartment 26 as set forth hereinabove.

While first and second securing members 40, 38 may be cooperating snap buttons or the like, it is preferred that they be cooperating of plastic hook and eye elements commonly known as Velcro. It is, of course, optional which of such hook or eye elements 40 be provided on the closure flap 19 as long as the other of the cooperating eye or hook elements 38 are provided on the back side of web 12, in particular behind the compartment 28 in an area within accessibility of contact with first securing member 40 when closure flap 19 is folded downwardly along hinge area 36 over the folded compartments 30, 28.

Figure 5:
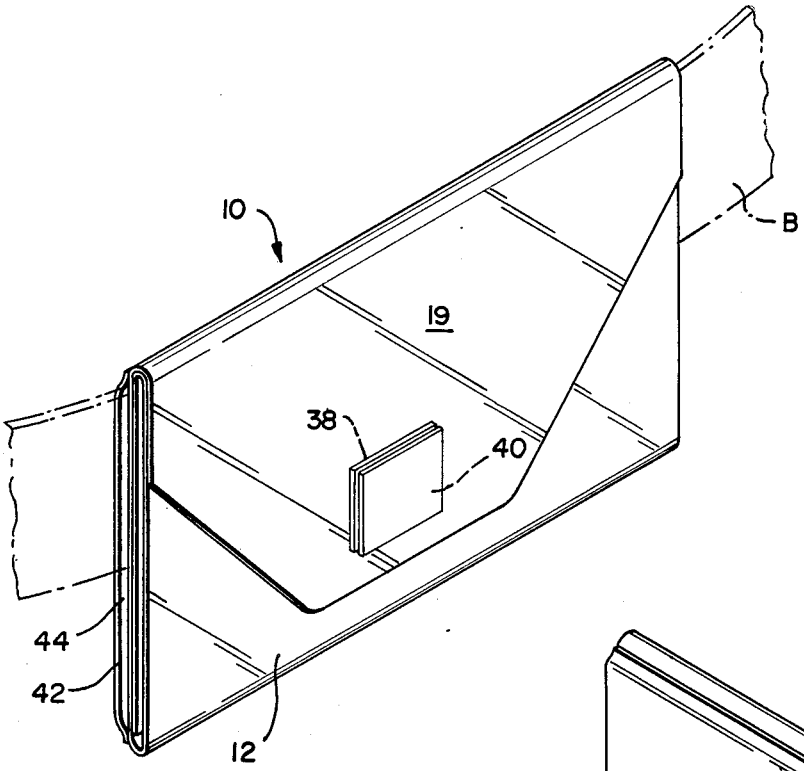
FIG. 5 is a front elevational view in perspective of the disclosed invention in the condition appearing in FIG. 4, but showing the folded cover flap closed over the adjacent compartment or pocket.
Figure 4:
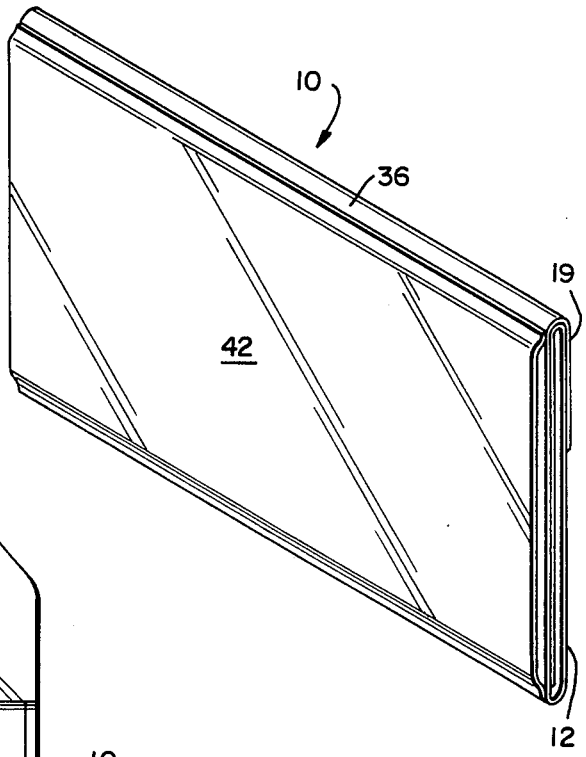
FIG. 4 is a rear elevational view in perspective of the disclosed invention in the condition illustrated in FIG. 3, but with the cover flap folded down over the adjacent compartment or pocket.
Figure 3:
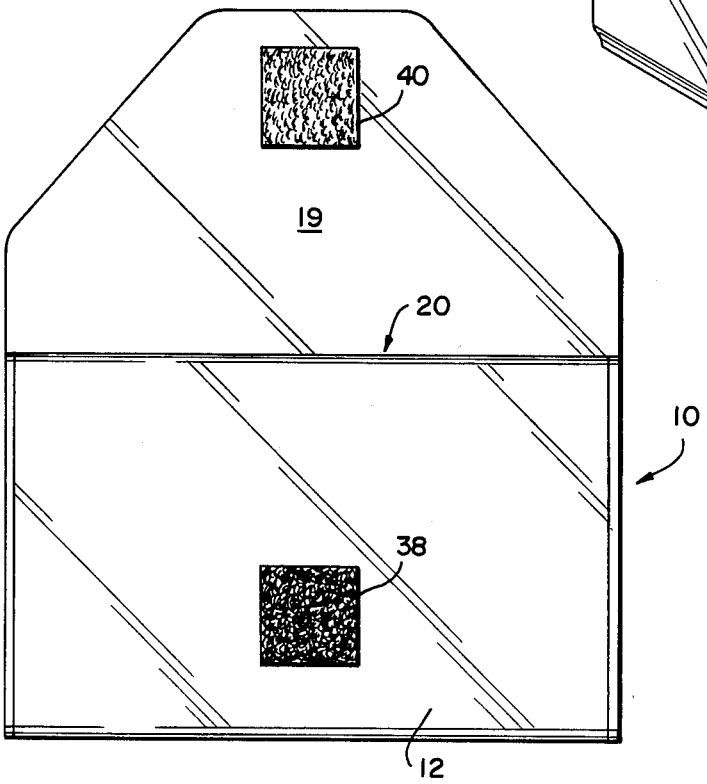
FIG. 3 is a view of the disclosed invention similar to FIG. 1 with the compartments or pockets folded over each other, but prior to closing the cover flap extending upwardly therefrom.

Looking at FIG. 5 in which a fully packaged receptacle 10 is represented as being suspended on a belt B worn by a rescue worker, a first pair of gloves G may be dispensed therefrom merely by pulling closure flap 19 to separate first securing member 40 from second securing member 38, raising closure flap 19 clear of compartments 26, 28, 30 in the manner illustrated in FIG. 3. A first pair of gloves G may then be withdrawn from the opening 20 of compartment 26 while compartments 28 and 30 are still folded against compartment 26 with only slight pressure so that the contents of the latter still folded compartments 28 and 30 are unexposed to the atmosphere. In the event that it is desired to dispense a second pair of gloves G from receptacle 10, it is necessary only to unfold compartment 28 by unfolding it about hinge area 34 to expose its opening 22 to withdraw gloves G while holding compartment 30 against compartment 28 to avoid exposing the contents of compartment 30. To gain access to the gloves in compartment 30, it is, of course, necessary to unfold it, for example, as illustrated in FIG. 2 thereby exposing opening 24.

In applying the disclosed invention to its intended use, a package of gloves is provided which comprises a multi-compartment receptacle 10 for packaging and storing a plurality of pairs of protective gloves G to be carried by a single person whereby each pair of gloves G may be distributed to one of several persons on a rescue team, hospital crew, or like group of persons. The package includes a web 12 of foldable flexible material which in an extended condition thereof has a closure flap 19 and a series of hinge areas 36, 34, 32; a series of compartments 26, 28, 30; first and second securing members 40, 38; and a carrying member 42. The web 12 of foldable flexible material includes a front side and a back side, the series of compartments 26, 28, 30 are disposed on the front side of web 12. Carrying member 42 is disposed on the back side of web 12 behind first compartment 26. Each of the compartments 26, 28, 30 has an opening 20, 22, 24 along an upper edge thereof adjacent to and beneath each of the hinge areas 36, 34, 32 extending transversely from side to side of web 12. In the closed or packaged condition of the package, each of the compartments 26, 28, 30 starting with the last compartment 30 is folded along a preceding one of the hinge areas 32, 34 over a preceding one of the compartments. Closure flap 19 extends from the first one of the hinge areas 36 to a free end of web 12 and is folded along first hinge area 36 over the compartments with each of the compartments 30, 28 folded against the respective preceding compartments 28, 26. First securing member 40 is disposed on the front side of web 12 on closure flap 19. Second securing member 38 is disposed on the back of web 12 behind second compartment 28 in contact and cooperation with first securing member 40 with closure flap 19 folded thereagainst. The package 10 is further characterized in that web 12 and each of the compartments 26, 28, 30 are of clear plastic material and are formed with a single heat sealed edge seam along the bottom and opposite side edges of the compartment 26, 28, 30. The disclosed package 10 is further characterized in that carrying member 42 comprises a sheet of plastic material adhered to the back of web 12 along upper and lower edges of the sheet thereby providing passage for a carrying belt B between the sheet of plastic material and web 12 from either side edge of the sheet. Also, included in the disclosed package is the feature of first and second securing members 40, 38 in the form of cooperating plastic hook and eye Velcro elements.

While the invention as disclosed includes three compartments, it is to be understood that the invention may include more than three or even less than two compartments.

It will be obvious to those skilled in the art that various changes may be made without departing from the scope of the invention; and therefore, the invention is not limited to what is shown in the drawings and described in the specification but only as indicated in the appended claims.

What is claimed is:

1. A multi-compartment receptacle for packaging and storing a plurality of pairs of protective gloves to be carried by a single person whereby each pair of gloves may be distributed to one of several persons on a rescue team, hospital crew, or like group of persons, said receptacle comprising:

a. a web of foldable flexible material which in an extended condition thereof includes a closure flap and a series of hinge areas;

b. a series of compartments;

c. first and second securing means; and d. carrying means;

wherein said web of foldable flexible material includes a front side and a back side, said series of compartments are disposed on said front side of said web of material, said carrying means is disposed on the back side of said web of material behind said first compartment and is adapted to be releasably secured to the body of said person, each of said compartments having an opening along an upper edge thereof, each of said hinge areas extending transversely from side to side of said web of material above the opening of one of said compartments whereby each of said compartments starting with the last compartment may be folded along a preceding one of said hinge areas over a preceding one of said compartments, said closure flap being disposed above the first one of said hinge areas and extending to a free end of said web of material whereby said closure flap may be folded along said first hinge area over said compartments after each of said compartments has been folded against the respective preceding compartment, said first securing means being disposed on the front side of said web of material on said closure flap, said second securing means being disposed on the back of said web of material behind said second compartment in a position accessible for contact and cooperation with said first securing means when said closure flap is folded thereagainst.

2. A receptacle as defined in claim 1 wherein said web of material and each of said compartments are of clear plastic material and each of said compartments is formed with a single heat sealed edge seam along the bottom and opposite side edges of the compartment.

3. A receptacle as defined in claim 1 wherein said carrying means comprises a sheet of plastic material adhered to the back of said web of material along upper and lower edges of said sheet thereby providing passage for a carrying belt between said sheet of plastic material and said web of material from either side edge of said sheet.

4. A receptacle as defined in claim 1 wherein said first and second securing means comprise cooperating plastic hook and eye Velcro elements.

5. A receptacle as defined in claim 1 wherein said first and second securing means comprise cooperating plastic hook and eye Velcro elements; and said web of material and each of said compartments are of clear plastic material with each of said compartments being formed with a single heat sealed edge seam along the bottom and opposite side edges of the compartment.

6. A receptacle as defined in claim 1 wherein said web of material and each of said compartments are of clear plastic material and each of said compartments is formed with a single heat sealed edge seam along the bottom and opposite side edges of the compartment; and wherein said carrying means comprises a sheet of plastic material adhered to the back of said web of material along upper and lower edges of said sheet thereby providing passage for a carrying belt between said sheet of plastic material and said web of material from either side edge of said sheet.

7. A receptacle as defined in claim 1 wherein said first and second securing means comprise cooperating plastic hook and eye Velcro elements; and said carrying means comprises a sheet of plastic material and is adhered to the back of said web of material along upper and lower edges of said sheet thereby providing passage for a carrying belt between said sheet of plastic material and said web of material from either side edge of said sheet.

8. A receptacle as defined in claim 7 wherein said web of material and each of said compartments are of clear plastic material and each of said compartments is formed with a single heat sealed edge seam along the bottom and opposite side edges of the compartment.

9. A package of gloves comprising a multi-compartment receptacle for packaging and storing a plurality of pairs of protective gloves to be carried by a single person whereby each pair of gloves may be distributed to one of several persons on a rescue team, hospital crew, or like group of persons, said receptacle including:

a. a web of foldable flexible material which in an extended condition thereof has a closure flap and a series of hinge areas;

b. a series of compartments;

c. first and second securing means; and d. carrying means;

wherein said web of foldable flexible material includes a front side and a back side, said series of compartments are disposed on said front side of said web of material, said carrying means is disposed on the back side of said web of material behind said first compartment and is adapted to be releasably secured to the body of said person, each of said compartments having an opening along an upper edge thereof, each of said hinge areas extending transversely from side to side of said web of material above the opening of one of said compartments; and wherein in the closed or packaged condition, each of said compartments starting with the last compartment is folded along a preceding one of said hinge areas over a preceding one of said compartments, said closure flap extends from the first one of said hinge areas to a free end of said web of material and is folded along said first hinge area over said compartments with each of said compartments folded against the respective preceding compartment, said first securing means being disposed on the front side of said web of material on said closure flap, said second securing means being disposed on the back of said web of material behind said second compartment in contact and cooperation with said first securing means when said closure flap is folded thereagainst.

10. A package as defined in claim 9 wherein said web of material and each of said compartments are of clear plastic material and each of said compartments is formed with a single heat sealed edge seam along the bottom and opposite side edges of the compartment.

11. A package as defined in claim 9 wherein said carrying means comprises a sheet of plastic material adhered to the back of said web of material along upper and lower edges of said sheet thereby providing passage for a carrying belt between said sheet of plastic material and said web of material from either side edge of said sheet.

12. A package as defined in claim 9 wherein said first and second securing means comprise cooperating plastic hook and eye Velcro elements.

13. A package as defined in claim 9 wherein said first and second securing means comprise cooperating plastic hook and eye Velcro elements; and said web of material and each of said compartments are of clear plastic material with each of said compartments being formed with a single heat sealed edge seam along the bottom and opposite side edges of the compartment.

14. A package as defined in claim 9 wherein said web of material and each Of said compartments are of clear plastic material and each of said compartments is formed with a single heat sealed edge seam along the bottom and opposite side edges of the compartment; and wherein said carrying means comprises a sheet of plastic material adhered to the back of said web of material along upper and lower edges of said sheet thereby providing passage for a carrying belt between said sheet of plastic material and said web of material from either side edge of said sheet.

15. A package as defined in claim 9 wherein said first and second securing means comprise cooperating plastic hook and eye Velcro elements; and said carrying means comprises a sheet of plastic material and is adhered to the back of said web of material along upper and lower edges of said sheet thereby providing passage for a carrying belt between said sheet of plastic material and said web of material from either side edge of said sheet.

16. A package as defined in claim 15 wherein said web of material and each of said compartments are of clear plastic material and each of said compartments is formed with a single heat sealed edge seam along the bottom and opposite side edges of the compartment.

* * * * *